US010987526B2

(12) United States Patent
Codega et al.

(10) Patent No.: US 10,987,526 B2
(45) Date of Patent: Apr. 27, 2021

(54) DESCENDER

(71) Applicant: CAMP S.p.A., Lecco (IT)

(72) Inventors: Antonio Codega, Lecco (IT); Matteo Rivadossi, Lecco (IT); Mauro Galimberti, Lecco (IT)

(73) Assignee: CAMP S.p.A., Lecco (IT)

( * ) Notice: Subject to any disclaimer, the term of this patent is extended or adjusted under 35 U.S.C. 154(b) by 228 days.

(21) Appl. No.: 16/151,047

(22) Filed: Oct. 3, 2018

(65) Prior Publication Data

US 2019/0099626 A1 Apr. 4, 2019

(30) Foreign Application Priority Data

Oct. 4, 2017 (IT) ..... 102017000111007

(51) Int. Cl.

| | |
|---|---|
| ***A62B 1/14*** | (2006.01) |
| *A62B 1/20* | (2006.01) |
| *A63B 29/02* | (2006.01) |
| *A63B 29/00* | (2006.01) |

(52) U.S. Cl.

CPC ..... *A62B 1/14* (2013.01); *A62B 1/20* (2013.01); *A63B 29/00* (2013.01); *A63B 29/02* (2013.01)

(58) Field of Classification Search

CPC ..... A62B 1/145; A62B 1/20; A63B 29/00; A63B 19/02

See application file for complete search history.

(56) References Cited

U.S. PATENT DOCUMENTS

| | | | | |
|---|---|---|---|---|
| 8,100,231 | B2 * | 1/2012 | Petzl | A62B 1/14 188/65.5 |
| 2009/0026023 | A1 * | 1/2009 | Petzl | A62B 1/14 188/65.4 |
| 2011/0073417 | A1 * | 3/2011 | Chaumontet | A62B 1/14 188/65.5 |

(Continued)

FOREIGN PATENT DOCUMENTS

| | | |
|---|---|---|
| EP | 1 834 672 A1 | 9/2007 |
| EP | 2 018 894 A1 | 1/2009 |

(Continued)

OTHER PUBLICATIONS

Italian Search Report for corresponding Italian Patent Application No. 102017000111007 dated May 15, 2018, 7 pages.

*Primary Examiner* — Alvin C Chin-Shue
(74) *Attorney, Agent, or Firm* — Merchant & Gould P.C.

(57) ABSTRACT

A descender is for work at height, climbing, mountaineering, speleology or other practices using a rope. The descender device for a textile rope (F) includes a casing in which a cam mechanism (10) and an actuating lever (3) for the cam mechanism (10) are housed. The casing (2) includes a return element (13) for the rope (F). The cam mechanism (10) includes a lever pin (29) rotatably actuated by the actuation lever (3) and a movable cam (25) which is rotatably movable between a deactivation position and a locked position in which the movable cam (25) presses on the rope (F) against the return element (13). The lever pin (29) acts on a rocker member (32) which is integral with the movable cam (25) during a first rotation step of the lever pin (29) in a direction opposite to the activation direction of the movable cam (25).

12 Claims, 5 Drawing Sheets

(56) References Cited

U.S. PATENT DOCUMENTS

| | | | | |
|---|---|---|---|---|
| 2014/0196985 | A1* | 7/2014 | Moine | A63B 29/02 182/19 |
| 2016/0225730 | A1* | 8/2016 | Tatsumi | H01L 24/73 |
| 2016/0287913 | A1* | 10/2016 | Bell | A62B 1/14 |
| 2019/0351264 | A1* | 11/2019 | Ratalino | A62B 1/14 |

FOREIGN PATENT DOCUMENTS

| | | | |
|---|---|---|---|
| EP | 3 124 081 | A2 | 2/2017 |
| FR | 2 721 523 | A1 | 12/1995 |
| WO | 2015/071626 | A1 | 5/2015 |

* cited by examiner

DESCENDER

This application claims benefit of Serial No. 102017000111007, filed 4 Oct. 2017 in Italy and which application is incorporated herein by reference. To the extent appropriate, a claim of priority is made to the above disclosed application.

FIELD OF THE INVENTION

The present invention relates to a descender which can be used for works at height, climbing, mountaineering, speleology or any other practice which envisages access by using a textile rope.

BACKGROUND ART

In the practice of works at height, mountaineering, climbing or speleological explorations, descenders are tools widely used to secure a user, i.e. to keep the user suspended when the rope is subjected to load and to facilitate the user's safe descent. The descender uses the friction which is created between the body of the tool (generally metallic) and the rope to dissipate the kinetic energy that the user's body would acquire if it were to free-fall.

There are various types of descenders, from the simplest, e.g. 8-shaped descenders, to the most sophisticated, with a cam mechanism which can be operated by means of a lever. More recently, descenders of this type provided with an anti-panic system have been suggested, in order to prevent the user, in a panic situation, to hold the lever in released position with the consequence of causing an uncontrolled descent with disastrous consequences.

Although these recent devices are functional and safe, the mechanism contained in them makes dimensions excessive and can hinder the user's movements.

SUMMARY OF THE INVENTION

The problem underlying this invention is therefore to make available a descender device which is safe, easy to use and user-friendly both during rope inserting and removing maneuvers; and which is convenient to use and compact in size.

Such problem is solved by a descender device as outlined in the accompanying claims, the definitions of which form an integral part of the present invention.

Further features and advantages of the present invention will be apparent from the description of a preferred embodiment, given here by way of non-limiting example.

DETAILED DESCRIPTION OF THE INVENTION

Figure 3:
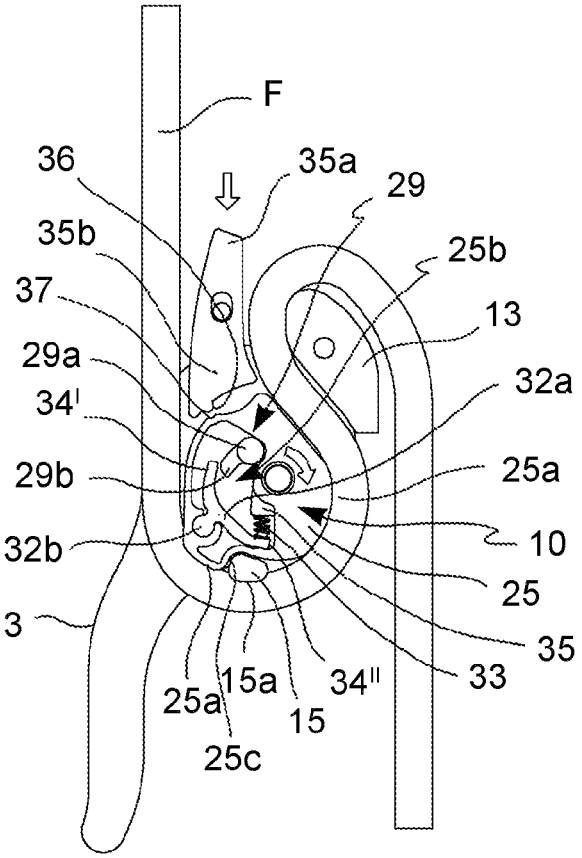
FIG. 3 shows a plan view of the cam mechanism of the descender device in the resting condition.

With reference to the figures, the descender device of the invention, indicated as a whole by the reference numeral 1, comprises a casing 2 in which a cam mechanism 10 is housed (FIG. 3). An actuating lever 3 of the cam mechanism 10 is hinged to casing 2.

The casing 2 comprises a main body 4 having a lower portion 5 in which an eyelet 6 is obtained to secure the descender to the user's harness or to a fixed point or anchoring. The expression "lower portion" refers to the position that such portion assumes during the use of the descender when it is used in connection with a harness and the operator descends along the textile rope anchored above him or herself.

The actuating lever 3 comprises a substantially circular hinge portion 3*a* and a lever portion 3*b*. The lever portion 3*b* comprises a knurled surface 7 which improves the user's grip.

Figure 1:
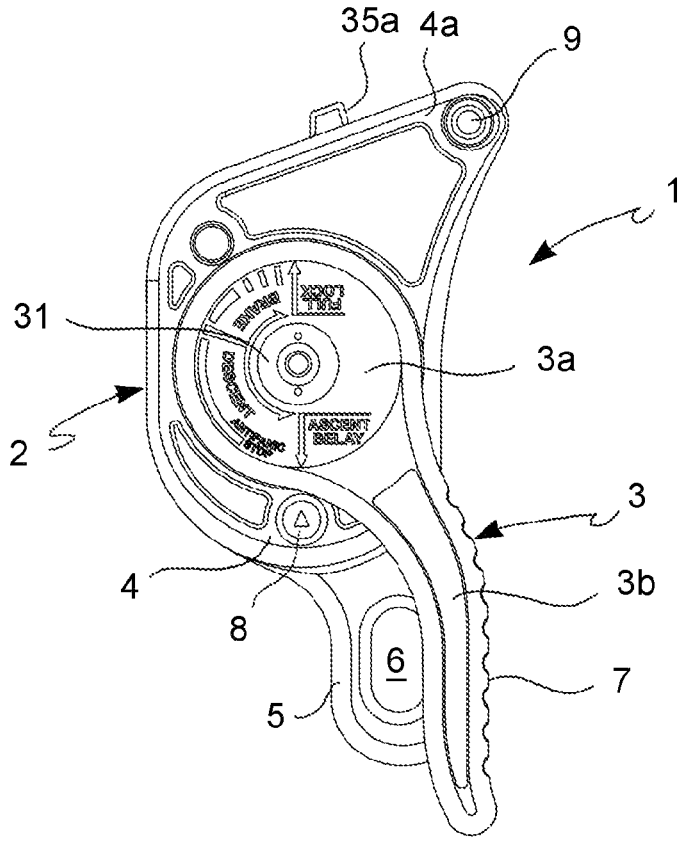
FIG. 1 shows a plan view of the descender device of the invention.

As shown in FIG. 1, lettering and/or notches indicating the various operating positions of the device may be written and/or engraved on the hinge part 3*a* of the lever 3 in order to facilitate its use.

Figure 2:
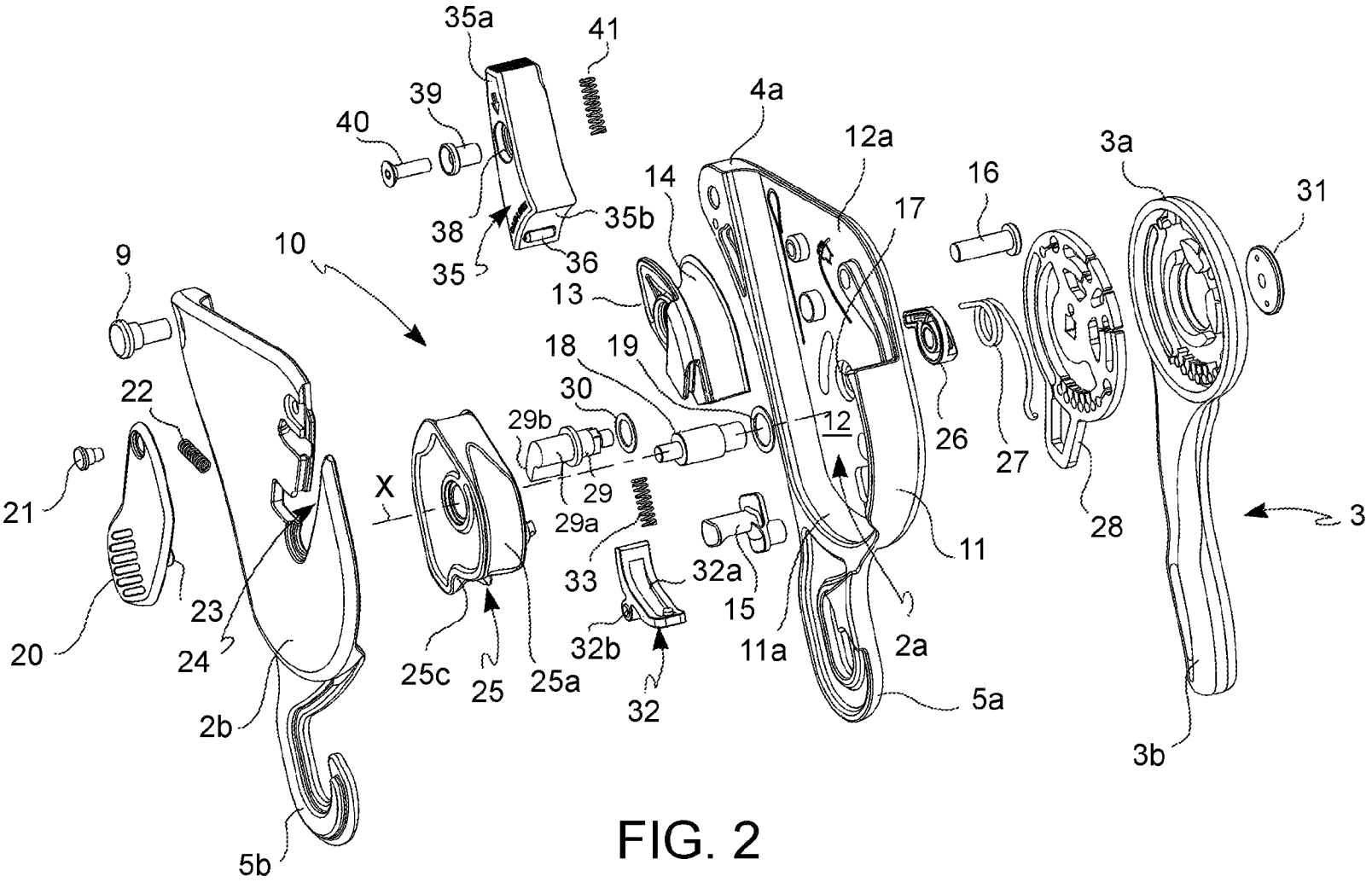
FIG. 2 shows an exploded perspective view of the descender device in FIG. 1.

With reference to FIG. 2, the casing 2 comprises a first half-shell 2*a* and a second half-shell 2*b*. The second half-shell 2*b* is hinged onto the first half-shell 2*a* by means of a pin 9 at one end 4*a* of the main body 4 opposite to the lower portion 5. In this manner, the second half-shell 2*b* may be rotated allowing access to the compartment of the first half-shell 2*a* in which the cam mechanism 10 is housed.

The half-shells 2*a*, 2*b* comprise respective lower portions 5*a*, 5*b* which together form the lower portion 5 of the casing 2. In the embodiment shown in the figures, the lower portion 5*a* of the first half-shell 2*a* comprises the eyelet 6, while the lower portion 5*b* of the second half-shell 2*b* is hook-shaped, but nothing prevents them from being inverted or from both having the eyelet 6. The presence of a hook and eyelet makes it possible to install and remove the rope from the device without needing to disconnect it from the harness or from the anchoring point; at the same time, the shape of the hook prevents the accidental opening of the device if a load is applied to the rope F.

The first half-shell 2*a* comprises a U-shaped edge 11, the semicircular section 11*a* of which is arranged contiguously to the lower portion 5*a*. The side 11 forms a compartment 12 in which the cam mechanism 10 is housed and creates a containing edge for a textile rope F, which may slide along it.

A return element 13 for the rope F is fixed at the upper end 12*a* of compartment 12 using a pin 16 (see FIGS. 3 and 4A-4F). The expression "upper end" means an end which is positioned in upper position during the use of descender 1 if it is used in connection with a harness and the operators descend along the textile rope anchored above them, as will be clear in the following description.

The return element 13 has a curvilinear shaped groove 14, in which the rope F can slide forming a first loop, as shown for example in FIG. 3.

The compartment 12 comprises, adjacent to the semicircular section 11*a* of the side 11, a stop element 15, the function of which will be apparent from the description below. The stop element 15 comprises a curvilinear lower surface 15*a* (FIG. 3), so as to facilitate the sliding of the rope F which forms a second loop at the semicircular section 11*a* of the side 11.

The compartment 12 comprises a hole 17 in substantially central position in which a lever pin 29 is inserted with the interposition of a washer 30. The lever pin 29 comprises a cylindrical portion 29*a* from which a tab 29*b* protrudes radially.

The expression "substantially central position" means a position which does not necessarily coincide with the geometric center of the compartment 12 or of the main body 4, but which is sufficiently distant from the side 11 to allow the housing of the cam mechanism 10 and the sliding of rope F about it and along the side 11 itself.

The lever pin 29 is coupled, on the outer face of the first half-shell 2*a*, to a rotational element 28 which is housed inside the hinge portion 3*a* of the operating lever 3. A lock washer 31 secures the lever 3 in place. In this manner, the rotation of the lever pin 29 is achieved by rotating actuating lever 3, according to the sequence of operations shown in FIGS. 4A-4F, which is described below.

The cam mechanism 10 comprises a movable cam 25, hinged on a pin 18 so that it can rotate freely around the X axis of the pin and in an activation direction (shown, for example, in FIG. 3 by a clockwise arrow) between a deactivation position (FIG. 3) and a locking position (FIGS. 4A, 4B and 4C), in which the movable cam 25 presses on the rope F against the return element 13.

The pin 18 is inserted, with the interposition of a washer 19, in a hole (not shown) eccentric to the hole 17.

The movable cam 25 has a substantially curvilinear and pear-shaped and comprises a side surface facing the side 11, comprising at least one portion 25*a* shaped as a groove so as to facilitate the housing and the sliding of the rope F.

The side surface of the movable cam 25 comprises a loop 25*c* at the lower portion, i.e. the portion of the surface facing the curvilinear portion 11*a* of the side 11. The shape and size of such loop 25*c* are such to accommodate the stop element 15, making it possible to lighten the load supported by the movable cam and facilitating the movement by means of the lever 3 without excessive efforts by the user.

The movable cam 25 comprises a cavity 25*b* which houses the lever pin 29 and a rocker member 32.

The rocker member 32 comprises an arched portion 32*a* from which a cylindrical relief 32*b* protrudes in a substantially median position. The cylindrical relief 32*b* is coupled with a cylindrical housing in cavity 25*b* of the movable cam 25, so as to allow the rocker member 32 to swing.

One end 34' of the arched portion 32*a* of the rocker member 32 is positioned, in the resting condition of the descender 1 (FIG. 3, cam 25 in the deactivation position, lever 3 and lever pin 29 facing downwards), at the end of the tab 29*b* of the lever pin 29, without interfering with it. The opposite end 34" of the arched portion 32*a* is contrasted by a spring 33, preferably a helical spring, which in turn presses on a contrast element 35 obtained in the cavity 25*b* of the movable cam 25.

On the outer face of the first half-shell 2*a* there is a bushing 26 for a spring 27, preferably a torsion spring, operationally associated with the mobile cam 25, so as to allow it to be recalled from the locking position to the deactivation position.

Above the movable cam 25, a locking member 35 of the movable cam 25 is slidingly positioned over the open side of the U-shaped side 11 in the deactivation position.

The locking member 35 comprises a button portion 35*a* which protrudes from the casing 2 so as to be directly activated by the user, and a locking portion 35*b* on which a relief 36 is placed adapted to interfere with a recess 37 present in corresponding position on the side surface of the movable cam 25 when the latter is in deactivation position.

The locking member 35 comprises a slot 38, through which a bushing 39 and a fixing screw 40 are inserted to the surface of the compartment 12. The locking member 35 internally comprises a spring 41, preferably a helical spring, which presses on the inner surface of comprises 35 on the one hand and on the bushing 39 on the other. By acting on the button portion 35*a* in the direction of the arrow in FIG. 3, the interference between relief 36 and recess 37 is obtained so as to lock the movable cam 25 in the deactivation position. Conversely, by releasing the pressure on the button portion 35*a*, the spring 41 recalls the locking member 35 to its initial position, so that the movable cam 25 is free to rotate.

The second half-shell 2*b* comprises an opening lever 20, hinged by means of a pin 21 and equipped with a return spring 22. The opening lever 20 comprises, on the surface facing the second half-shell 2*b*, a relief 23 which through an opening 24, is accommodated in a seat (not shown) inside the compartment 12, so as to hold the second half-shell 2*b* closed. The release of such relief 23 by means of the opening lever 20 allows the subsequent opening of the second half-shell 2*b* and so the access to compartment 12, e.g. in order to insert the rope F at the beginning of use or to remove it at the end.

The operation of the descender device 1 according to the invention will now be described.

FIG. 3 shows the descender 1 with the rope F inserted, but in resting or unused condition.

Figure 4A:
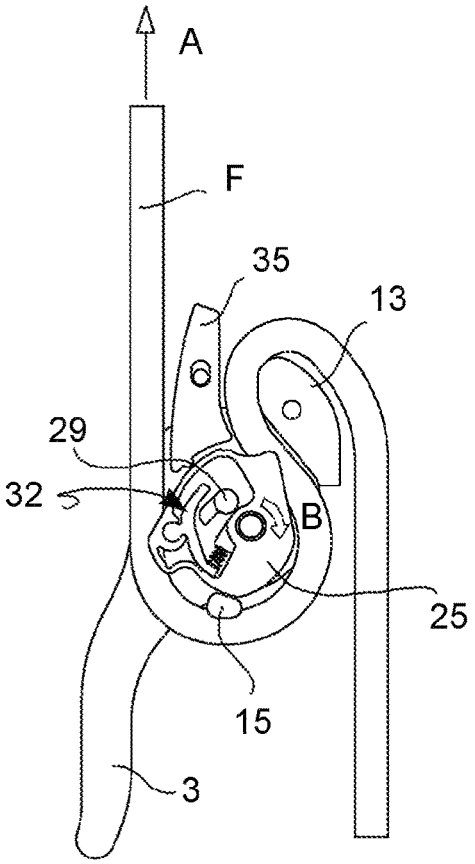
FIG. 4A shows a plan view of the cam mechanism of the descender device in the loaded condition.

FIG. 4A, instead, shows the descender in use, in which the rope F is subjected to a load in the direction of the arrow A, a situation that typically occurs when the user remains hanging on the rope or when the user is lowering a second operator with the descender connected to an anchoring. Due to its design, the movable cam 25 is thus made to rotate in the direction of arrow B (activation direction of the movable cam 25). So, the upper part of the movable cam 25 acts on the rope F, tightening it between it and the surface of the return element 13. The friction stops the rope F from sliding and the user remains suspended. It should be noted that in this position of the movable cam 25 the lever pin 29 remains positioned inside the rocker member 32 and therefore does not interfere with it.

Figure 4B:
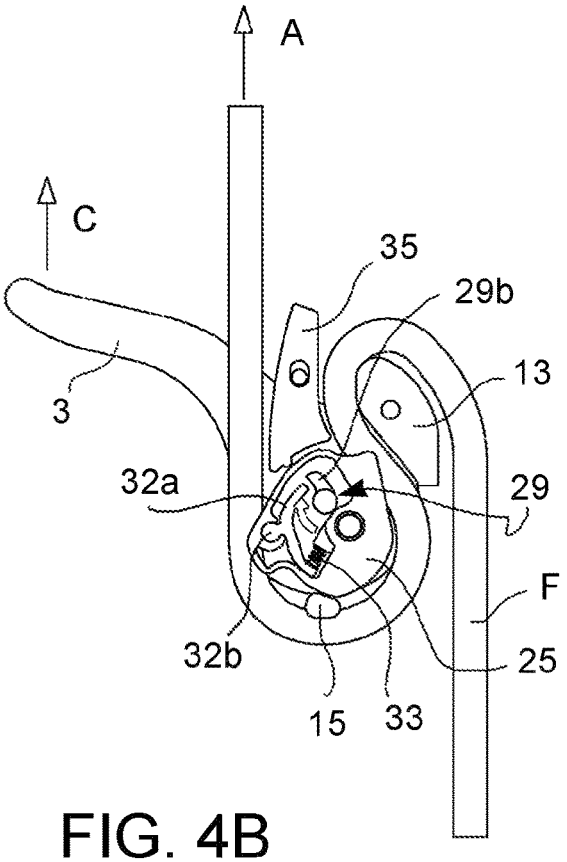
FIG. 4B shows a plan view of the cam mechanism of the descender device in the lever rearming condition.

When wanting to start the descent, the user must obtain the gradual release of the rope F. For this purpose, as shown in FIG. 4B, the lever 3 must be rotated upwards along direction C in order to rearm the actuating lever 3. During this operation, the tab 29*b* of the lever pin 29 presses against the concave surface of the arched portion 32*a* of the rocker member 32, which then tilts against the resistance of the spring 33, whereby allowing the lever pin 29 to reach the upper position shown in FIG. 4B. The spring 33 allows the rocker member 32 to return to its initial position once the interference with the lever pin 29 is removed.

Figure 4C:
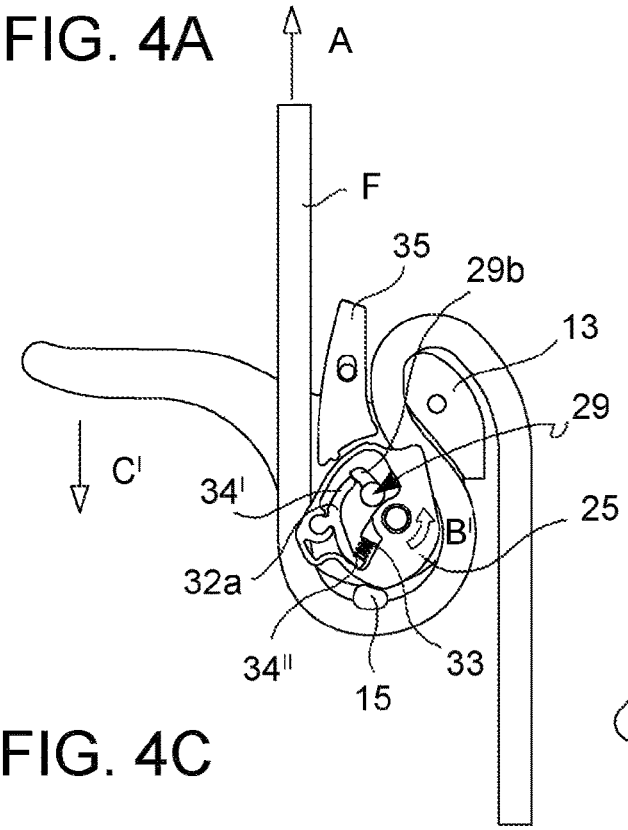
FIG. 4C shows a plan view of the cam mechanism of the descender device in the descent condition.

The next phase, shown in FIG. 4C, envisages rotating the lever 3 in the direction C', opposite to the rearming direction C. As can be seen in figure (which shows the beginning of this operative phase), the tab 29*b* of the lever pin 29 acts on the end 34' of the arched portion 32*a* of the rocker member 32, which causes the rotation of the cam member 25 in the direction B' opposite to the activation direction B.

Gradually as the movable cam 25 rotates in this direction (FIG. 4D), the pressure on the rope F is relieved and the friction is gradually reduced, which results in controlled sliding of the rope F in the direction of the arrow A.

Figure 4D:
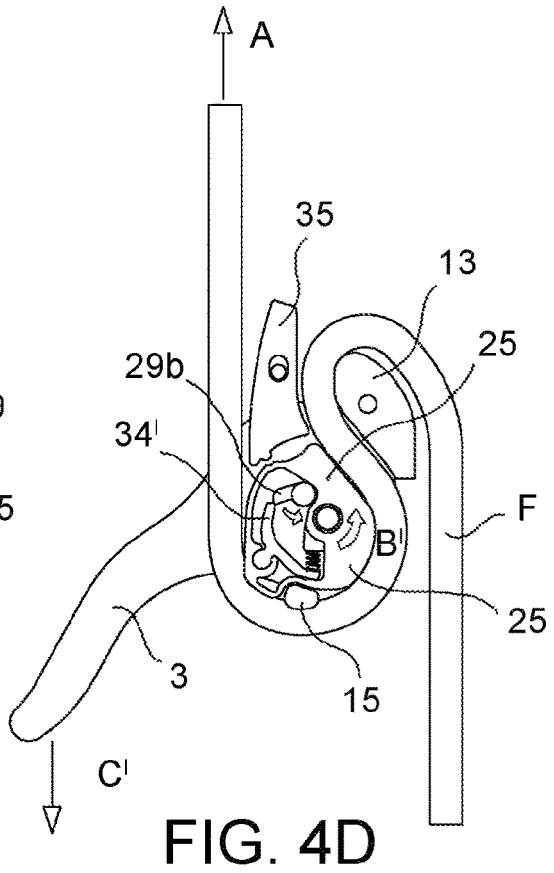
FIG. 4D shows a plan view of the cam mechanism of the descender device in a snapping position of the anti-panic system.
Figure 4E:
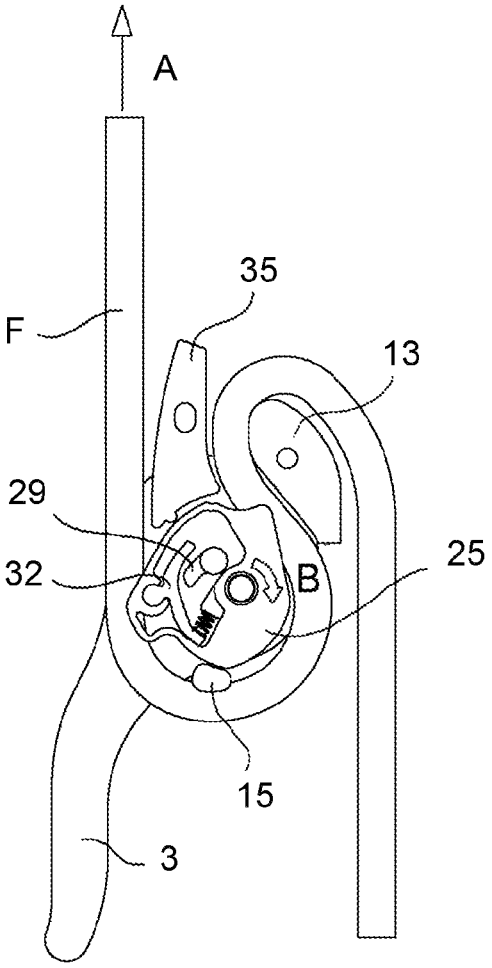
FIG. 4E shows a plan view of the cam mechanism of the descender device with the anti-panic system activated.

However, if the user, either in panic or accidentally, rotates the lever 3 in direction C' beyond the position in FIG. 4D, the tab 29*b* of the lever pin 29 exceeds the interference position with the end 34' of the rocker member 32, so that the movable cam 25, under the bias of the load on the rope F along direction A, rotates again in direction B, whereby locking the rope F and thus preventing the user from falling (FIG. 4E).

Figure 4F:
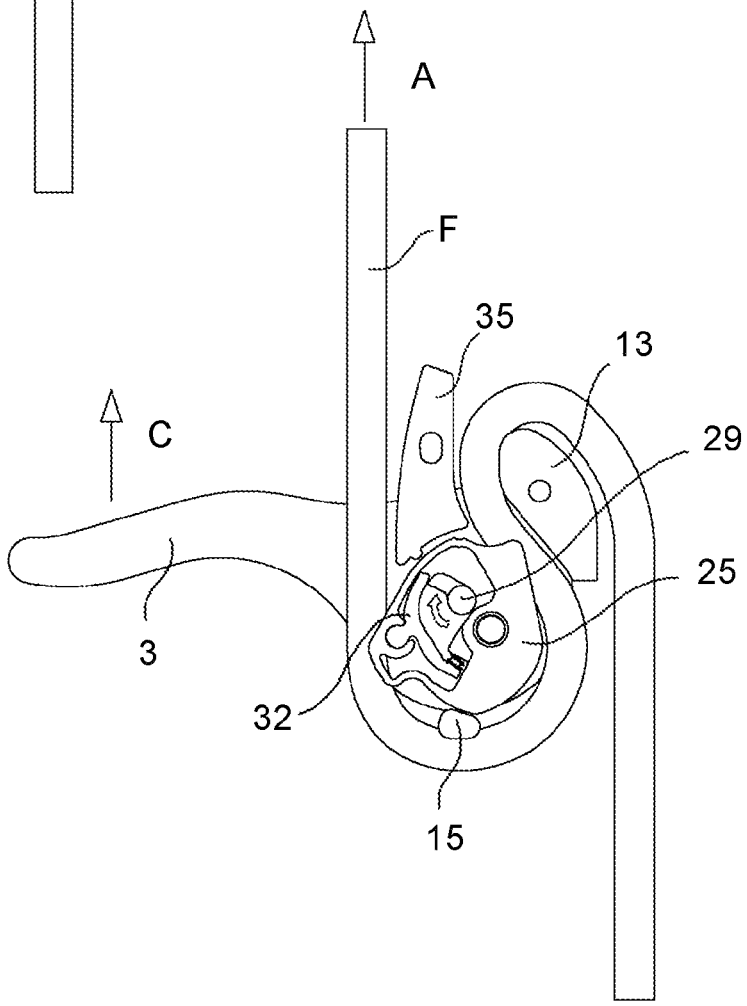
FIG. 4F shows a plan view of the cam mechanism of the descender device during lever rearming.

A new descent operation can be started by moving the actuating lever 3 upward in direction C, in order to rearm the lever pin 29 (FIG. 4F).

The movable cam 25, as mentioned above, is associated with a spring 27 which allows its return to the deactivation position in absence of load on the rope F. This is useful both at the end of the use of descender 1 and when it is necessary to move horizontally, for example.

Figure 5:
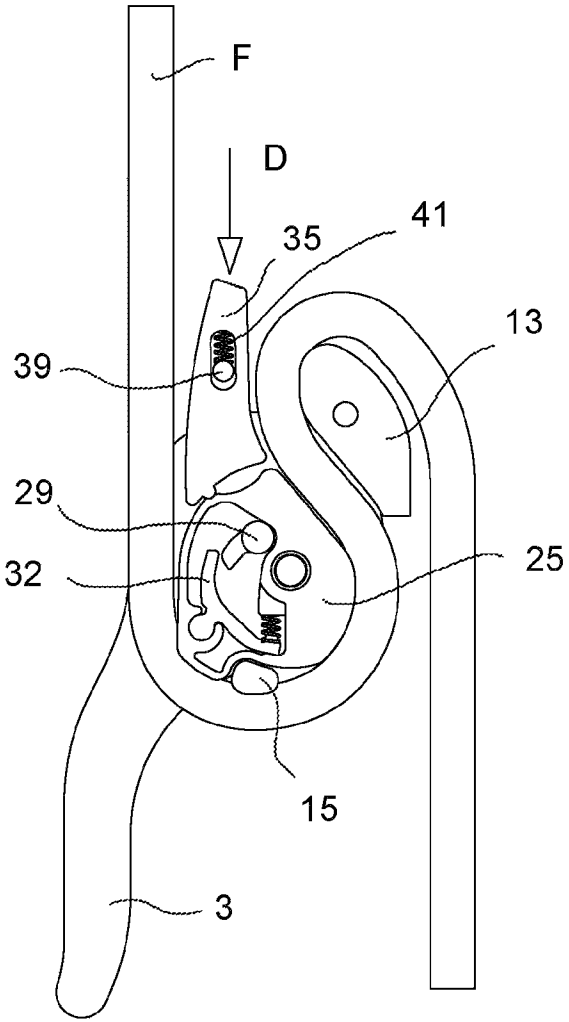
FIG. 5 shows a plan view of the cam mechanism of the descender device in a different working condition.

In the latter case, it is essential for the rope F to slide freely. In order to facilitate this operation, the descender device 1 of the invention includes the locking member 35 which, with a simple pressure by the user along direction D in FIG. 5, allows the movable cam 25 to be locked in its deactivation position. The user can then slide the rope F freely during its horizontal movement, whereby restoring the safety condition by releasing the locking device 35 which, due to the action of the spring 41, returns to the initial position.

Figure 6:
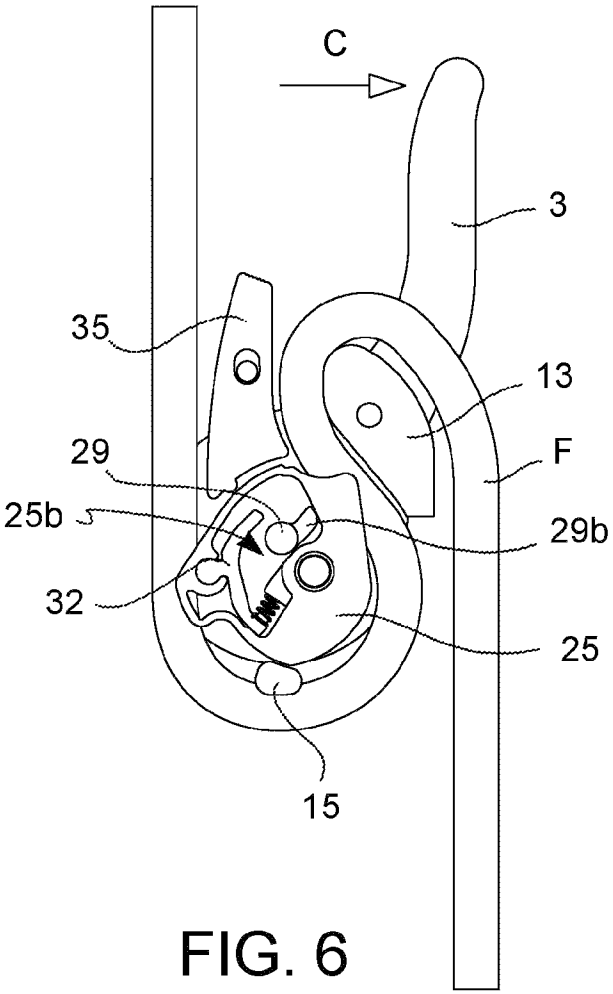
FIG. 6 shows a plan view of the cam mechanism of the descender device in manual locking condition.

FIG. 6, instead, shows a different position of the actuating lever 3, in which the tab 29*b* of lever pin 29 interacts with the inner surface of the cavity 25*b* of the movable cam 25, whereby locking it in the position of maximum interference with the rope F and thus its total locking position.

The invention achieves the goals initially set, by providing a descender 1 which is compact, lightweight, small in size and easy to make.

It is apparent that only a particular embodiment of the present invention has been described, to which a person skilled in the art will be able to make all the changes necessary to adapt it to particular conditions, without because of this departing from the claimed scope of protection.

What we claim is:

1. A descender device for a rope, comprising a casing wherein a cam mechanism and a actuating lever for the cam mechanism are housed in the casing, wherein the casing comprises a return element for the rope, wherein the cam mechanism comprises a lever pin rotatably actuated by the actuation lever and a movable cam which is rotatably movable in an activation direction between a deactivation position and a lock position wherein the movable cam presses on the rope against the return element, and wherein the lever pin is configured to act on a rocker member which is integral with the movable cam during a first rotation step of the lever pin in a direction opposite to the activation direction of the movable cam;

wherein a side surface of the movable cam comprises a loop at a lower portion, said loop having a shape and size to accommodate a stop element integral with the casing.

2. The descender device according to claim 1, wherein the lever pin is configured so that in a second step of further rotation of the lever pin in the direction opposite to the activation direction of the movable cam, the lever pin is free of interference with the rocker member of the movable cam.

3. The descender device according to claim 1, wherein the casing comprises a first half-shell and a second half-shell, in which the first half-shell comprises a side with a U shape which forms a compartment wherein the cam mechanism is housed, and which creates a containment side for the rope.

4. The descender device according to claim 3, wherein the lever pin is arranged in a substantially central position in the compartment and comprises a cylindrical portion from which a tab radially protrudes.

5. The descender device according to claim 1, wherein the movable cam is hinged in eccentric position with respect to the lever pin.

6. The descender device according to claim 3, wherein the movable cam has a substantially pear-shaped curvilinear shape, comprising at least one portion shaped as a groove to facilitate the housing and sliding of the rope.

7. The descender device according to claim 1, wherein the movable cam is operatively associated with a spring to allow return of the movable cam from the lock position to the deactivation position.

8. The descender device according to claim 1, wherein the casing comprises a locking member of the movable cam in the deactivation position.

9. The descender device according to claim 8, wherein the locking member comprises a button portion which protrudes from the casing to be directly activated by a user, and a locking portion on which is placed a relief adapted to interfere with a recess in a corresponding position on the side surface of the movable cam when the movable cam is in the deactivation position.

10. The descender device according to claim 8, wherein the locking member is slidable between a resting position and a position of interference with the movable cam and wherein the locking member comprises a spring for return of the locking member into the resting position.

11. A descender device for a rope, comprising a casing wherein a cam mechanism and a actuating lever for the cam mechanism are housed in the casing, wherein the casing comprises a return element for the rope, wherein the cam mechanism comprises a lever pin rotatably actuated by the actuation lever and a movable cam which is rotatably movable in an activation direction between a deactivation position and a lock position wherein the movable cam presses on the rope against the return element, and wherein the lever pin is configured to act on a rocker member which is integral with the movable cam during a first rotation step of the lever pin in a direction opposite to the activation direction of the movable cam;

wherein the rocker member comprises an arched portion having a convex surface, in substantially median position, from which a cylindrical relief protrudes that is couplable with a cylindrical seat of the movable cam, which comprises an oscillating hinge of the rocker member.

12. The descender device according to claim 11, wherein an end of the arched portion of the rocker member presses on a spring, and wherein the spring presses on a contrast element.

* * * * *